United States Patent [19]

Borenstein et al.

[11] Patent Number: 4,651,771

[45] Date of Patent: Mar. 24, 1987

[54] HYDRANT PROTECTIVE CAP AND COVER STRUCTURE AND OPERATING WRENCH THEREFOR

[76] Inventors: Daniel W. Borenstein, 3014 N. Southport, Chicago, Ill. 60657; Arnold L. Borenstein, 2818 W. Chase, Chicago, Ill. 60645

[21] Appl. No.: 886,330

[22] Filed: Jul. 7, 1986

[51] Int. Cl.[4] ..... F16K 35/06; E03B 9/06; E03B 9/14

[52] U.S. Cl. ..... 137/296; 81/121.1; 81/439; 220/85 P; 220/284; 220/367; 137/382; 137/800

[58] Field of Search ..... 137/272, 296, 371, 377, 137/381, 382, 382.5, 800; 220/284, 85 P, 253, 256, 367, 374; 81/121.1, 124.4, 125.1, 177.2, 437, 439; 251/291

[56] References Cited

U.S. PATENT DOCUMENTS

| | | | |
|---|---|---|---|
| 2,063,678 | 12/1936 | Hulme | 215/215 |
| 2,519,572 | 8/1950 | Hill | 220/256 |
| 2,605,665 | 8/1952 | Grenat | 81/124.4 |
| 3,157,203 | 11/1964 | Ver Nooy | 220/256 |
| 3,935,877 | 2/1976 | Franceschi | 137/296 |
| 4,182,361 | 1/1980 | Oakey | 137/296 |
| 4,526,193 | 7/1985 | Drach | 137/296 |

*Primary Examiner*—George L. Walton

*Attorney, Agent, or Firm*—Richard J. Myers & Assoc.

[57] ABSTRACT

A fire hydrant cap and cover assembly which is provided with a hydrant operating wrench therefor. The cap of the assembly has an interior threaded cap portion which attaches to the threaded portion of the hydrant water outlet discharge pipe. The exterior cover is rotatably attached to the cap (and rotates with respect thereto) through an annular groove on the cap, the groove engaging a ring bead fixed on the cover. A pentagonal shaped wrench is inserted into the pentagonal shaped recessed portion in the cap by way of a circular opening in the exterior of the cover to engage the cap. Through rotation of the cap, its interior threaded portion can be unscrewed from the threaded hydrant water outlet discharge pipe to enable the removal of the cap and cover assembly. This arrangement prevents tampering with the hydrant water discharge pipe. The cap recessed portion is provided with a fluid drain and vent aperture communicating with the hydrant valve and indication of leaking on the seat.

20 Claims, 4 Drawing Figures

FIG. 1
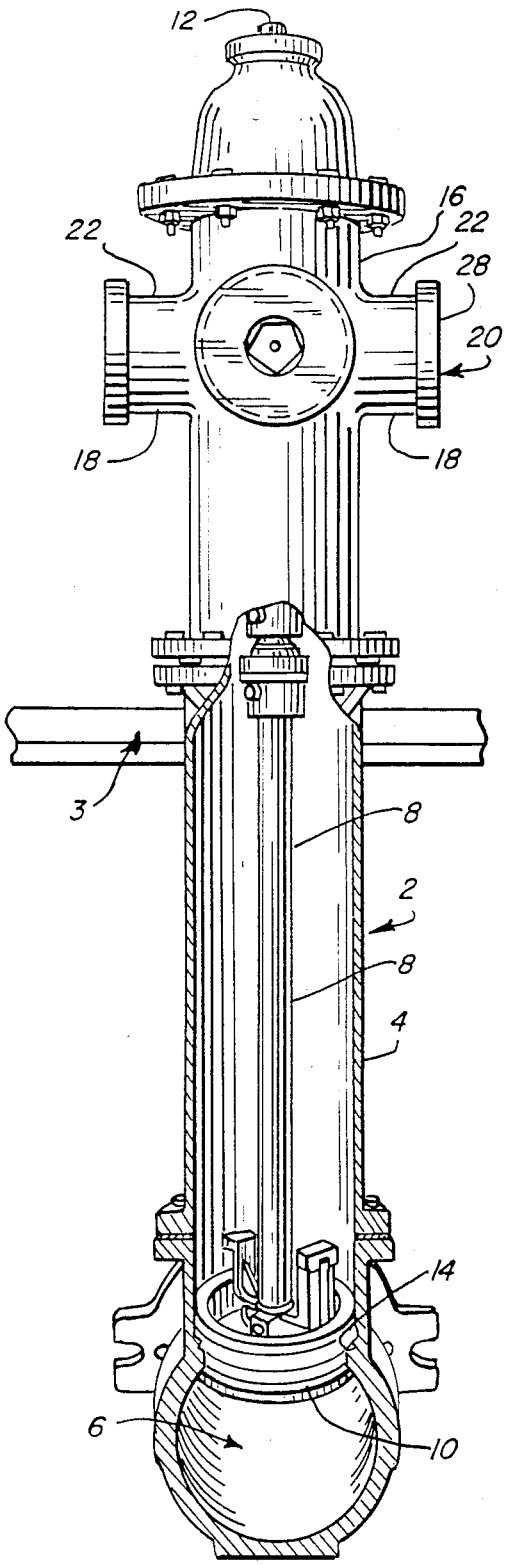
FIG. 2
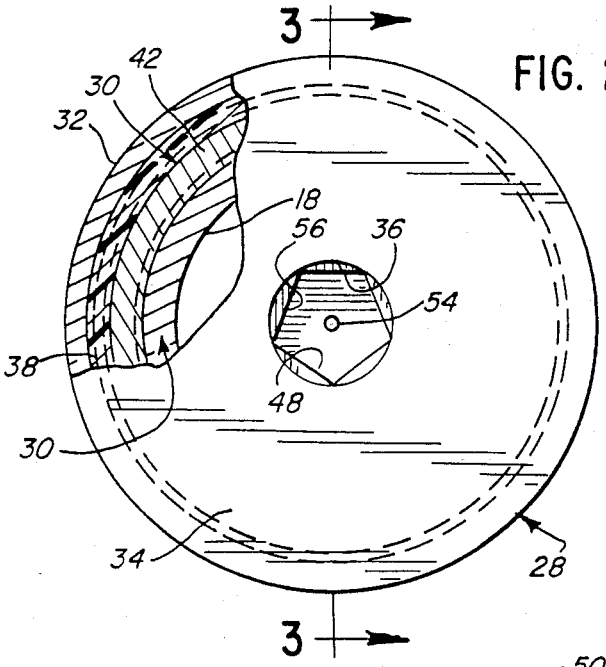
FIG. 4
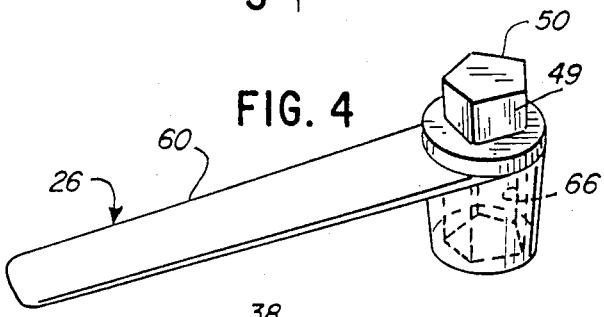
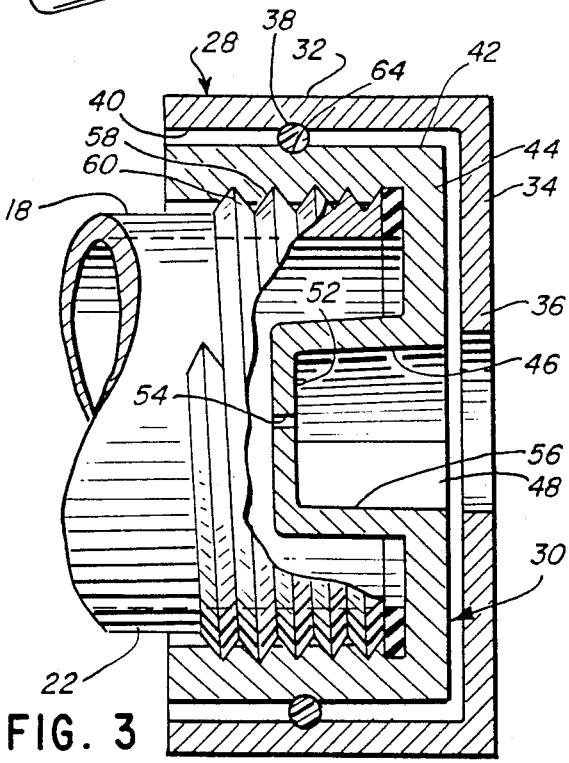
FIG. 3

HYDRANT PROTECTIVE CAP AND COVER STRUCTURE AND OPERATING WRENCH THEREFOR

BACKGROUND OF THE INVENTION

1. Field of the Invention

This invention relates to improvements in fire hydrants in particular for providing a tamper proof hydrant arrangement.

2. Description of the Prior Art

It is known for instance, to provide for a fire hydrant which may not be operated by unauthorized persons and which can be operated only by use of a key member, the hydrant being arranged so that the outlets there are normally covered and can only be uncovered when the hydrant is unlocked and in particular the hydrant valve nut member is concealed which is located on top of the hydrant and which controls the opening and closing of the hydrant valve. Such an arrangement is shown by U.S. Pat. No. 2,869,576 to W. Kennedy. Further there is shown U.S. Pat. No. 3,450,148 to R. Mongelluzzo et al. a locking arrangement for a hydrant that includes lock bolt means removably received in the bolt opening in the housing and in the valve stem for securing the cap means over the valve stem and preventing movement of the valve stem. Further U.S. Pat. No. 3,556,131 to R. Diaz discloses a hydrant arrangement where the nut that operates the valve is concealed and a special wrench is required to engage the nut through a limited access. Similarly U.S. Pat. No. 3,623,498 to G. Manahan provides for a top barrel bonnet to the top of hydrant for limiting operation of the hydrant valve. Further U.S. Pat. No. 3,709,249 to R. Diaz provides for a novel wrench arrangement to operate the top collar covering the hydrant valve whereby the hydrant valve. U.S. Pat. No. 3,935,877 to Peter Franceschi provides for a tamper proof locking system for a standard fire hydrant which includes a cap assembly that fits over the valve stem of the hydrant and can only be operated by a special wrench.

None of the foregoing patents disclose an arrangement for locking the hydrant discharge pipe which extends out of the side of the hydrant as distinguished from the top of the hydrant which has the nut for operating the valve stem. However, U.S. Pat. No. 4,182,361 to E. Oakey does disclose a fire hydrant protection device which prevents unauthorized individuals from tampering with the fire hydrant where there is provided an outlet cap member having a projection for engagement by a special wrench for removal or installation of the cap and a cover member movably associated therewith preventing access to the cap member projection. Also such a tamper proof device can be installed over the valve actuating mechanism, however, there is nothing in the prior art that shows an arrangement for preventing access to the hydrant discharge pipe which includes a cap and cover therefor provided with suitable orifice structure operated by a wrench that will open the discharge pipe as well as the hydrant valve.

Removal of the cap in the prior art under emergency conditions is quite difficult and introduction of any foreign objects under the rotating cap makes it most difficult to remove the cap for hydrant operation. In addition firefighters must carry several tools to operate the hydrant, one for the standard pentagon projection and one for the prior art device.

SUMMARY OF THE INVENTION

A fire hydrant serves a number of purposes. Its primary function is to provide water for fighting fires and for public service equipment. A secondary function is to periodically flush water lines to eliminate sediment or treatment chemicals from potable water supplies. To allow firefighters and other authorized personnel access to water and still limit unauthorized people from wasting water and possibly damaging hydrants or contaminating them, the hydrant manufacturing industry standardized on a pentagon shaped projection on the top of the hydrant to operate the hydrant valve, which is located below ground to prevent freezing. The same projection extends from the the caps that cover the hydrant discharge ports. Operation of a hydrant is simple in that one tool is used to remove the hydrant cap so hoses can be connected after which the same tool is used to turn on the hydrant valve. Unfortunately, a large pipe wrench can be used to accomplish the same operation so that anybody can operate the hydrant at any time.

The subject invention disclosed herein which is simple and comparatively inexpensive to manufacture prevents unauthorized personnel from using fire hydrants, and allows operation of all standard hydrants, with one simple tool.

My novel inventive arrangement provides for a fire hydrant cap and cover assembly unit complete with a wrench for operating same, the interior of the cap being threaded and releaseably attachable to the hydrant discharge port or pipe structure and wherein exterior cover is rotatably mounted on the cap through means of an annular groove and bead or receiving structure, with the cover rotatably protecting the cap removal. A multi-faceted wrench is insertable into a facet orifice structure in the cap, the wrench passing through an opening in the exterior cover in order to engage the cap. Rotation of the cap permits removal of the cap and cover assembly from the hydrant discharge structure.

It is therefore a general object of my invention to provide for a novel cover and cap arrangement for protecting the discharge port of the hydrant against tampering.

Another object of my invention is to provide for a tamper proof design for a hydrant discharge pipe that will remove the cap and cover of my invention by the use of a single wrench or tool which can also rotate the valve member atop of the fire hydrant.

It is another object of my invention to provide for a wrench having a recessed socket for operating the valve stem and a projection socket structure for operating the cap and cover arrangement protecting the hydrant discharge structure.

It is a further object of my invention to provide for an apertured structure in the hydrant cap said socket portion to provide indication of shut off valve leakage and ventilating of the interior of the hydrant and the valve structure of the hydrant.

It is a further object of my invention to provide for wrench receiving orifice in my novel cover described above that is in line with the recessed portion of the cap to permit insertion of the wrench through the cover orifice and into the recessed portion of the cap.

These and other objects of my invention will become apparent from reference to the following description and appended claims, and from the accompanying drawing.

BRIEF DESCRIPTION OF THE DRAWINGS

FIG. 1 is an elevational view of a fire hydrant of this invention, partially in sections of this invention;

FIG. 2 is a side elevational view of the novel cap and cover arrangement protectively covering the discharge pipe of the fire hydrant, partially in section;

FIG. 3 is a sectional view taken along line 3—3 of FIG. 2 and illustrative in partial view of the novel relationship between the hydrant discharge pipe and the cap and cover of my invention; and FIG. 4 is a perspective view of the novel wrench used in my inventive arrangement for locking and unlocking my novel cap and cover structure protecting the hydrant discharge arrangement and preventing tampering therewith.

DETAILED DESCRIPTION OF THE PREFERRED EMBODIMENT

With reference now to FIG. 1 there is shown a fire hydrant 2 which includes an upright hollow or cylindrical tubular body portion 4. The housing or body portion 4 contains the valve structure 6 which includes a vertically extending valve stem mechanism 8 which at its lower end carries the valve body 10 and at the upper end thereof carries the valve nut or operating pentagonally shaped end structure 12 which is operated in suitable fashion by some form of wrench to raise or lower the valve member 10 against the valve seat 14 located at the lower end of the cylindrical tubular member 4. It is noted that the fire hydrant tube extends below the ground 3 a sufficient amount so that the valve 10 and its seat 14 is below the frost line. Projecting from the upper portion 16 of the tubular housing 4 is a plurality of discharge ports or pipes 18.

The novel cap and cover structure 20 of my invention is located at the outer end 22 of each discharge port or pipe 18. The cap and cover structure 20 when in place functions as an end cap structure for a hydrant and that is to prevent unrestricted flow of the water from the hydrant when the valve 10 is off of its seat 14 permitting the water in the ground or pipelike passageway 24 from passing up the tubular housing core when the valve nut 12 has been operated so as to raise the valve 10 off of the valve seat 14. Such operation of the hydrant to allow water out of the discharge port is a normal operation and commonly known and further showing in such patents as U.S. Pat. No. 2,869,576 to Kennedy and U.S. Pat. No. 4,182,361 to Oakey. My novel arrangement lies in the particular construction of the cap and cover arrangement 20 that covers the end of the discharge port or pipe 18 and which cap and cover structure 20 is operated by the novel wrench mechanism 26 as shown in FIG. 4 all of which is to be described below.

With reference now to FIGS. 1-3 and in particular with reference to FIGS. 2 and 3 my novel hydrant discharge port or pipe cap and cover structure 20 includes the outer cover member 28 and the inner cap member 30. The cover member 28 has an annular cylindrical wall 32, an outer annular cover plate part 34 which is provided with an annular aperture or orifice 36 and an annular ring or bead member 38 affixedly attached to the inside wall portions 40 of the annular or cylindrical wall 32. The cap member 30 is located underneath the cover member 28 which covers the cap member 30. The cap member 30 is provided with an annular skirt or cylindrical wall 42 which is in vertical alignment with and covered by wall or skirt 32 of the cover member 28. In the cap member 30 is also provided with a vertically extending end portion or cylindrical plate part 44 which is in horizontal alignment with the cover plate part 34 of the cover 32, the plate portion 34 similarly covering the plate portion 44.

The cover end plate part 44 is provided with a recessed portion or plug receiving female portion or part 46 of pentagonal shape including five sides 48 to receive the pentagonal sides 49 plug portion 50 of the novel wrench structure 26 shown in FIG. 4. The plug 10 and the recess 46 and recess 66 are tapered shape. The recessed portion of female receptacle part 46 is also provided with a bottom or a plate part 52 which is provided with an orifice or aperture 54 in the form of a venting or drain opening. It is to be noted that the pentagonal shaped bore 56 of the recessed portion 46 has a diameter which is slightly smaller than the diameter of the aperture or orifice 36 of the cover plate part 34. The orifice 54 in the centrally located bottom plate 52 is in axial alignment with the central portion of the door 56 and the aperture or orifice 36.

The discharge port or pipe 18 of the hydrant 2 is provided with an outer threaded end portion 58 and is threadingly received in the interior threaded portion 60 of the skirt 42 of the cap member 30. The skirt part 42 has an outer diameter surface 62 that is provided with a semi-circular recess or groove 64 outwardly of cap skirt threaded portion 60. The annular ring or bead member 38 is received in the cap groove portion 64 and allows the cover member 28 to rotate about the inner cap member 30 as the bead 38 moves relative to the groove 64.

The wrench structure 26 is provided with a handle 65 and a female recessed portion or valve stem pentagonally shaped nut receiving recessed portion 66 which is placed over the pentagonally shaped valve nut 12 for rotating the valve stem mechanism 8 and raising the valve member 10 off the valve seat 14 or lowering the valve member back on the valve seat 14. It is seen that the male portion 50 and the female portion 66 of the wrench are in vertical alignment with one another and the same wrench can be used for either rotating the female recessed portion 46 of the caps 30 or rotating the valve projection or nut 12. It is noted that the recessed portion of the cap 30 and the aperture 36 of the cover 28 and the vent 54 in the recessed portion 46 are all in axial alignment with the axis of the discharge pipe 18. Easy access is obtained to the cap with the wrench by such an arrangement. The vent 54 permits discharging or venting fluid from the valve passages or interior of the hydrant tube 4. It is noted that the threaded portion of the cap and cover are in vertical alignment with the female recessed portion 46 of the cap 30 to provide for easy torquing and untorquing movement of the cover and cap structure 20 with respect to the cap discharge 18.

It will be appreciated that various modifications could be made of the construction. For instance, the bead or ring member 38 could be fixed to the cap member 30 and rotate in a groove in the cover member 28. The cover plate can be of plastic material or of metal and the female plug portion 46 can be of brass or other material. To provide for easy access of the wrench within the cover and cap arrangement the opening in the cover is slightly larger than the opening in the cap to provide for easy entrance the cap socket 46. The outer cover 28 can be steel or ductile iron or brass or polycarbonate or other suitable plastic material. The sealer cap 30 can be a casting of ductile iron or brass or polycarbonate or other suitable plastic material. The bearing surfaces 38, 64 can be the ball bearings or mating ridges 38, and grooves, 64 and either one or two rings 38 can be used depending on material. A rubber gasket material or synthetic gasket can be provided where necessary to prevent metal seizing.

Thus what is provided by noval invention is a fire hydrant cap and cover assembly 20 and a hydrant operating wrench therefor. The cap 30 has an interior threaded skirt portion 42 which attaches to the threaded portion 22 of the hydrant water outlet discharge pipe 18. The exterior cover 32 is rotatably attached to the cap 30 through an annular groove 64 on the cap, the groove 64 engaging a ring bead 38 fixed on the cover. A pentagonal shaped projection 50 of wrench 26 is inserted into the pentagonal shaped recessed portion 46 in the cap by way of a circular opening 36 in the exterior 34 of the cover to engage the cap. Through rotation of the cap, its interior threaded portion 42 can be unscrewed from the threaded hydrant water outlet discharge pipe 18 to enable the removal of the cap and cover assmebly. This arrangement prevents tampering with the hydrant water discharge pipe. The cap recessed portion 46 is provided with a fluid drain and vent aperture 54 communicating with the hydrant valve 10 and seat 14 for appropriate draining and venting of the hydrant.

The foregoing description and drawings merely explain and illustrate the invention and the invention is not limited thereto, except insofar as the appended claims are so limited, as those skilled in the art who have the disclosure before them will be able to make modifications and variations therein without department from the scope of the invention.

What is claimed is:

1. A fire hydrant comprising:

a vertically extending tubular body for communication with a supply of water;

a valve in the body for controlling the flow of water out of the discharge pipe;

a horizontally extending water discharge pipe;

a cap and cover arrangement on the outlet end of the discharge pipe and extending generally horizontally outward thereof and including:

a cap releasibly mounted on the outlet end of the pipe in generally horizontal alignment with the pipe;

a cover mounted on the cap for rotation with respect thereto and in general axial alignment with the cap and the pipe;

said cap having generally a cap wrenching receiving means and adapted to be engaged by an associated wrench for rotatable removement from the end of the pipe;

said cover having a cover wrench receiving aperture in axial alignment with the cap receiving means and said cup receiving means being disposed within the interior of the pipe end through which the associated wrench passes for reception by the wrench receiving means for easy torquing and untorquing movement of said cap and said cover with respect to the outlet end of the discharge pipe;

said cover and said cap defining an annular space therebetween and in which is located coupling means for providing for rotational movement of said cover relative to said cap and said cover substantially encompasses said cap.

2. The invention according to claim 1, and said cap wrench receiving means including a recess portion within the cap.

3. The invention according to claim 1, and said cap having an outer wall portion between the hydrant valve and the cover and a vent and drain means in said outer wall portion allowing contaminants to exit from the valve and discharge pipe.

4. The invention according to claim 1, and a wrench having a cap operator engageable with said cap wrench receiving means in mounting and removing said cap carrying said cover and;

said hydrant having a valve stem connecting with valve and being in said upright hollow tubular portion and said wrench having a valve operating portion and a valve operator on said hydrant connecting with said stem and said wrench having the valve operating portion engageable with said valve operator to open and close the valve.

5. The invention according to claim 4, and said wrench comprising handle and an end portion connecting with the handle and having the cap operator on one side thereof and having the valve operator on the other side thereof.

6. The invention according to claim 1, and said cap having a cap wall over the end of the discharge pipe and a skirt portion extending axially of and surrounding the end of the discharge pipe and having pipe coupling means on the skirt releasibly coupling with the pipe.

7. The invention according to claim 6, and said wrench receiving means comprising a recess portion in the cap end wall and extending inwardly thereof into said pipe;

said cover having a cap wall extending over the cap wall and axially outward thereof and a cover skirt and extending around the cap skirt and the cap and the cover coupling means including being disposed between the skirts and connecting the same for rotation of the outer cover skirt relative to the inner cap skirt.

8. The invention according to claim 6, and said wrench receiving means comprising an axially extending pentagonal shaped recess portion adapted to receive of a complimentally shaped pentagonal projection portion of a cap removal wrench.

9. The invention according to claim 6, and said cap and cover coupling means including bearing means attached to and between the skirts;

said bearing means including an annular member fixed one of the skirts and groove in the other skirt constrained by the annular member for axially movement and rotatably supported for movement relation to the annular member.

10. The invention according to claim 1, and said cap having a pentagonal recess and said valve having a pentagonal projection and a wrench having a pentagonal projection for fitting the cap recess and a pentagonal recess for fitting the valve means, all of the recesses and projections be of the same fitting diametric dimension for opening and closing the valve means and discharge pipe.

11. The invention according to claim 1, and the vent in the cap recessed portion, the base of the cap recess portion, and the cover aperture all being in general axial alignment with one another.

12. A protection device for fire hydrants comprising:

a cap having a water closed outer end portion adapted from releasible securement to the end of the hydrant discharge pipe and having a horizontal cap wrench receiving means on the outer end portion;

a cover being rotatably mounting the cover on the cap over the cap end portion and including a wrench receiving aperture on its outer end in alignment with the recess for receiving a wrench therethrough and extending into the recess for removal of the cap and cover carried thereby from the discharge pipe while allowing easy torquing and untorquing movement of said cap and said cover with respect to the discharge pipe end;

said cap receiving means adapted to be disposed within the interior of the discharge pipe end, said cover and said cap defining an annular space therebetween and in which is located coupling means for providing for rotational movement of said cover relative to said cap and said cover substantially encompasses said cap.

13. The invention according to claim 12, and said cap wrench receiving means including a recess portion within the cap.

14. The invention according to claim 12, and a wrench having a cap operator engageable with said cap wrench receiving means in mounting and removing said cap carrying said cover.

15. The invention according to claim 12, and said cap having an outer wall portion between the hydrant valve and the cover and a vent drain means in said outer wall portion allowing contaminants to exit from the valve and discharge pipe.

16. The invention according to claim 12, and a wrench having a cap operator engageable with said cap wrench receiving means in mounting and removing said cap carrying said cover and;

said hydrant having a valve stem connecting with valve and being in said upright hollow tubular portion and said wrench having a valve operating portion and a valve operator on said hydrant connecting with said stem and said wrench having a valve operating portion engageable with said valve operator to open and close the valve;

said wrench comprising handle and an end portion connecting with the handle and having the cap operator on one side thereof and having the valve operator on the other side thereof.

17. The invention according to claim 12, and said cap having a cap wall over the end of the discharge pipe and a skirt portion extending axially of and surrounding the end of the discharge pipe and having pipe coupling means on the skirt releasibly coupling with the pipe;

said cover having a cap wall extending over the cap wall and axially outward thereof and a cover skirt and extending around the cap skirt and the cap and the cover coupling means including bearing means being disposed between the skirts and connecting the same for rotation of the outer cover skirt relative to the inner cap skirt;

said cap and cover coupling means including bearing means attached to and between the skirts;

said bearing means including an annular member fixed one of the skirts and groove in the other skirt constrained by the annular member for axially movement and rotatably supported for movement relation to the annular member.

18. The invention according to claim 12, and said cover wrench receiving aperture being slightly larger diametrically than said cap wrench receiving means by receiving an associated wrench therethrough.

19. The invention of claim 1 or claim 12, and a wrench for operating the valve and discharge pipe caps and covers protective device including a wrench socket portion and a wrench handle;

the wrench socket portion being at one end of the handle and having a projection portion on one side and at one end of the handle and on the opposite side and at the same end thereof a socket recessed portion having the same shape and internal diameter as the projection portion, the recessed portion being substantially an inversion of the projection portion, the wrench projection portion being adapted to extend through an aperture in the hydrant discharge pipe cover and into operative engagement with the conforming recessed portion of the associated cap in alignment with the cover aperture and rotatably carrying the cover portion and adapted to be releasably mounted on the end of the hydrant discharge pipe, the wrench recessed portion being adapted to couple on the conforming protection nut of the hydrant valve operator and operative thereof.

20. The invention according to claim 19, and said socket wrench recess portion having pentagonal shaped configuration for attachments to and operative of the hydrant valve complimentally pentagonal shaped nut, said socket wrench projection portion being a pentagonal sided shaped projection for attachment to and operative of the hydrant discharge pipe attaching cap and cover.

* * * * *